United States Patent [19]

Klie et al.

[11] Patent Number: 4,747,270

[45] Date of Patent: May 31, 1988

[54] COMPRESSED AIR STARTING DEVICE

[75] Inventors: Jürgen Klie; Hans W. Weiss, both of Sprockhövel, Fed. Rep. of Germany

[73] Assignee: G. Düsterloh GmbH, Sprockhövel, Fed. Rep. of Germany

[21] Appl. No.: 13,657

[22] Filed: Feb. 12, 1987

[30] Foreign Application Priority Data

Feb. 12, 1986 [DE] Fed. Rep. of Germany ..... 3604284

[51] Int. Cl.[4] ..... F02N 30/00

[52] U.S. Cl. ..... 60/627; 60/626; 123/179 F

[58] Field of Search ..... 60/418, 625, 626, 627; 123/179 F

[56] References Cited

U.S. PATENT DOCUMENTS 2,509,942 5/1950 Sanford ..... 60/626

2,953,127 9/1960 Adams et al. ..... 123/179 F

*Primary Examiner*—Stephen F. Husar

*Attorney, Agent, or Firm*—Toren, McGeady & Associates

[57] ABSTRACT

A compressed air starting device includes a starter with a starter motor operated at least indirectly from a pneumatic pressure reservoir and a meshing unit controlled by a signal input. A main valve is provided in the supply line between the pressure reservoir and the starter motor and a signal connection is provided between the meshing unit and the main valve. The compressed air starting device includes a control device with a sensor input for the pressure level in the pressure reservoir, a signal output connected to the signal input of the starter, a signal input for introducing the starter signal as well as an input for supplying the auxiliary energy required for generating signals. The auxiliary energy may be compressed air taken from the pressure reservoir. Electrical, mechanical or hydraulic energy can also be used as the auxiliary energy.

8 Claims, 4 Drawing Sheets

COMPRESSED AIR STARTING DEVICE

BACKGROUND OF THE INVENTION

1. Field of the Invention

The present invention relates to a compressed air starting device including a starter with a starter motor operated at least indirectly from a pneumatic pressure reservoir and a meshing unit controlled by a signal input.

2. Description of the Prior Art

Starting devices of this type make it possible to reliably mesh a starter pinion to the flywheel of an internal combustion engine and to reach the desired speed of the starter with relatively simple means.

However, a starter of this type requires that a starting valve be actuated during the entire starting procedure. This is true whether the starter is controlled manually or automatically, particularly electrically. The starter is separated from the compressed air source only after the starting valve has been brought into the closed position. The compressed air source may be via a compressed air supply or a compressed air reservoir.

Due to the continuous actuation of the starting valve during the starting phase, it is not possible to avoid in a reliable and satisfactory manner that excess speed of the starter occurs after the start of the internal combustion engine has occurred. This excess speed of the starter causes high wear and makes failure of the starter likely.

In a manually controlled starter, it may happen, for example, as the result of an oversight of the person operating the starter that the starter rotates with idle speed for a long period of time. This idle speed may become very high depending upon the level of pressure applied. As a result, the structural components remaining in engagement with the internal combustion engine must endure even higher speeds when overriding idle speed takes place.

In order to avoid these deficiencies, in automatic starters frequently a switching device is provided which operates in dependence upon the speed and which ends the starting procedure when a certain speed exceeding the starting speed has been reached. However, such a switching device not only makes the starter more complicated, it also does not provide reliable protection in the event of a malfunction or when the signal delays are too great.

Finally, in prior art starters, the compressed air reservoirs used in these starters are always dimensioned in such a way that several starting attempts are possible in the case of false starts without requiring an intermediate recharging of the compressed air reservoir. Generally, three to five starting attempts can be carried out. Therefore, it is desirable to keep the consumption of compressed air low.

It is, therefore, the primary object of the present invention to improve the compressed air starting device described above in such a way that the starting procedure can be automatically ended and excess speeds are avoided in a simple manner without requiring additional measuring or control device.

SUMMARY OF THE INVENTION

In accordance with the present invention, the compressed air starting device described above includes a main valve provided in the supply line between the pressure reservoir and the starter motor as well as a signal connection between the meshing unit and the main valve. In addition, a control device is provided which includes a sensor input for the pressure level in the pressure reservoir, a signal output connected to the signal input of the starter, a signal input for introducing the starting signal as well as an input for supplying the auxiliary energy required for generating signals.

An important aspect of the present invention resides in the fact that in conjunction with the specific control device the pressure reservoir is constructed with only such a capacity which is sufficient for carrying out only a single starting procedure. This is contrary to the starters disclosed in the prior art. In accordance with the present invention, the pressure drop in the pressure reservoir is intentionally utilized for limiting the maximum speed of the starter by the starter torque which decreases with increasing discharge of the pressure reservoir and in order to effect an immediate end of the starting procedure. The fact that the pressure drop is utilized requires that the pressure reservoir has a dimension in accordance with the specific requirements of each case of application. However, this can be done with relatively few problems because the mechanical and thermodynamic processes are known and particularly because digital computers can be used. Moreover, when the mechanical requirements of the internal combustion engine to be started are not sufficietly known, a pressure reservoir having a variable volume may be used.

Since the pressure drop in the pressure reservoir is exclusively used for ending the starting procedure, the starting device according to the present invention does not have the disadvantages attendant to manually or automatically controlled starting valves. It is particularly no longer required in the case of electrically controlled starters to use switching devices which are dependent on speed and are cumbersome and still prone to malfunction. These switching devices end the starting procedure after the ignition speed of the internal combustion engine has been exceeded. In accordance with the invention, the pressure reservoir can be made very small. It is advantageous to use a very high initial pressure. Thus, a substantial reduction in the quantity of compressed air is achieved.

The present invention further makes it possible to use electrical, mechanical or hydraulic energy as signal carriers. This is true for the signal input at the meshing units, the signal connection between the meshing unit and the main valve integrated in the supply line connecting the pressure reservoir with the starter, as well as the signal inputs and signal outputs and the control device. Of course, the connection between the control device and the starter is in each case adapted to the type of auxiliary energy supplied to the control device.

At the beginning of the starting procedure, the main valve remains in the closed position until a signal is supplied to the main valve at the end of the meshing phase which signal causes the main valve to assume the open position. The starter motor is now actuated until at the end of the starting phase the pressure at the switching connection of the main valve drops due to the pressure drop in the pressure reservoir. As a result, a resetting means returns the main valve into the initial position and no further supply of compressed air to the starter motor takes place.

In accordance with a preferred embodiment of the invention, the auxiliary energy is compressed air which advantageously may be taken from the pressure reservoir. The signals at the signal input of the starter, at the switching connection of the main valve and at the sensor input of the control device are pneumatic pressure signals. The particular advantage of utilizing pneumatic auxiliary energy resides in the fact that the number of connecting lines can be lowered and the starting device can be made structurally more compact.

In accordance with a particularly advantageous further development of the present invention, the pressure reservoir is permanently connected to a pressure source and a fluidic resistance means is arranged in the filling line between the pressure source and the pressure reservoir. The arrangement of such a fluidic resistance means or throttle has the consequence that the filling of the pressure reservoir takes place slowly, so that the pressure reservoir is available for another starting procedure only after the internal combustion engine and the starter are again at a standstill. This is particularly important with respect to safety because it makes unnecessary any safety rules which would require that a starting procedure can only be repeated after a false start after the starter and internal combustion engine have without doubt reached a standstill.

In accordance with another feature of the invention, a pressure reducing valve is integrated into the filling line between the pressure source and the pressure reservoir. This feature proves to be an advantage when the pressure source has a pressure level which is higher than that of the pressure reservoir. A pressure reducing valve of low rated value can be used. It is advantageous to provide the pressure reducing valve in the filling line between the pressure source and the fluidic resistance means. In accordance with another embodiment of the invention, the control device includes a pneumatic control valve which is switchable against the force of a resetting means. The pneumatic control valve includes an input work connection directly connected to the pressure reservoir, a signal connection for introducing the starting signal, and an output work connection connected to the signal input at the starter. The sensor input is coupled to the signal line between the output work connection and the signal input. This embodiment results in a very compact structure in which a manually or automatically controlled starting valve is functionally integrated in the control valve.

When the control valve is in the ready state it assumes a position which is determined by the resetting means, for example, a compression spring. The signal line is connected to the filling line between the pressure source and the pressure reservoir, preferably between the fluidic resistance means and the pressure reservoir, and to the signal input at the starter. This signal line is interrupted by the control valve and the signal input is connected through the control valve to the surroundings.

The meshing procedure is initiated by displacing the control valve in order to connect the input work connection of the control value to the output work connection. The position of the control valve is maintained by means of a coupling line leading to the sensor input of the control valve until, due to the pressure drop in the pressure reservoir occurring during the starting procedure, the pressure in the signal line also drops, so that the control valve is returned into the initial position by means of the resetting means and any further supply of compressed air to the meshing unit is interrupted. Since, in this embodiment, starting valve and control valve are structurally combined, only a single line is required from the filling line via the control valve to the signal input of the meshing unit.

In accordance with yet another embodiment of the invention, the control device includes a pneumatic control valve switchable against the force of a resetting means. The switching connection and the input work connection of this resetting means is connected to the filling line between the pressure source and the pressure reservoir. The output work connection of the control valve is connected to a switching connection of a flip-flop valve placed in the signal line between the signal input at the starter and the filling line. The other switching connection of the flip-flop valve is connected to a line which is connected to the pressure reservoir and is conducted through a starting valve. In this embodiment, the control valve and the starting valve are structurally separated. The functional connecting means is a flip-flop valve whose one switching connection in connected to the starting valve and whose other switching connection is connected to the control valve.

In the initial position, the control valve and the starting valve are displaced into positions in which compressed air cannot be conducted to the flip-flop valve either through the starting valve or through the control valve. In the case of the control valve, this is effected by the pressure in the pressure reservoir and, in the case of the starting valve, this is effected by the force of appropriate resetting means, preferably springs. In this initial position, the flip-flop valve is in a position which prevents compressed air from flowing therethrough.

When the starting valve is reversed either manually or automatically, compressed air can flow through the starting valve to the appropriate switching connection of the flip-flop valve and reverses the latter, so that compressed air is conducted through the flip-flop valve to the signal input of the meshing unit. The starting valve may be a manually operated pushbutton-type valve or an automatically controlled pulse-type valve. Therefore, the starting valve returns immediately into the ready state and the corresponding switching connection of the flip-flop valve also becomes pressureless immediately after the beginning of the starting procedure. Thus, after the pressure drops in the pressure reservoir toward the end of the starting phase, the force of the resetting means at the control valve overcomes the pneumatic force at the switching connection and reverses the control valve. As a result, compressed air is conducted through the control valve to the corresponding switching connection of the flip-flop valve and, thus, the flip-flop valve is displaced which causes an interruption of the compressed air supply to the signal input of the meshing unit. The starting procedure is ended immediately.

In accordance with the invention, a fluidic resistance means may be provided in the line between the flip-flop valve and the filling line. This feature may be advantageous if the starting device includes a hysteresis starter as described, for example, in German patent No. 33 30 314, so that an additional fluidic resistance means is arranged in front of the flip-flop valve in accordance with the specific requirements of such a starter.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
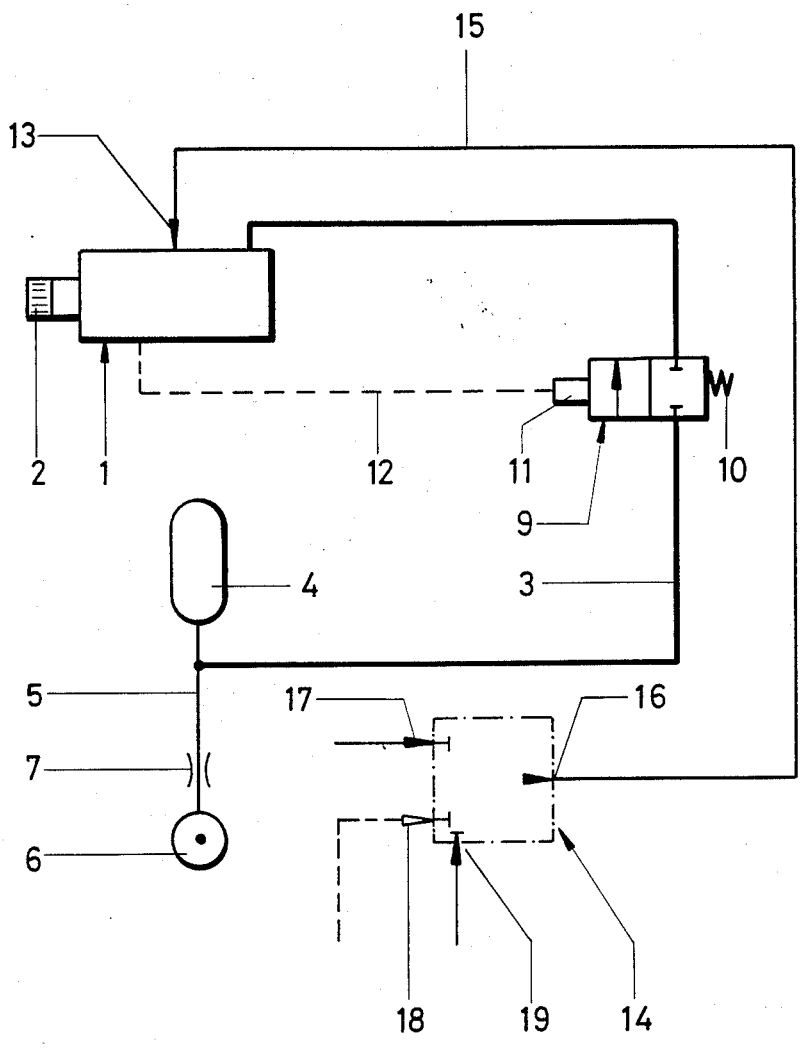
FIGS. 1 to 4 are schematic diagrams of four different embodiments of a compressed air starting device in accordance with the present invention.

In FIGS. 1 to 4 of the drawing, reference numeral 1 denotes a compressed air starter which includes a starter motor which is not illustrated in detail and a meshing unit which is also not illustrated in detail. Only a meshing pinion 2 is indicated of the meshing unit.

The starter motor is connected directly to a pneumatic pressure reservoir 4, to a pneumatic supply line 3. An indirect connection is also possible. Taking into consideration the mechanical and thermodynamic processes which occur, the pressure reservoir 4 is constructed so as to be adapted exactly to the mechanical requirements of the internal combustion engine which is not illustrated in detail. The pressure reservoir 4 is constructed in such a way that it can make available compressed air of as high an initial pressure as possible for only a single starting procedure.

Pressure reservoir 4 is connected to a compressed air source 6 through a filling line 5. Filling line 5 includes a fluidic resistance means 7 in the form of a throttle. This throttle is constructed in such a way that the pressure reservoir 4 is filled so as to be operational only when it is ensured that, for example, in the case of a false start, starter 1 and internal combustion have with certainty reached a standstill.

Figure 4:
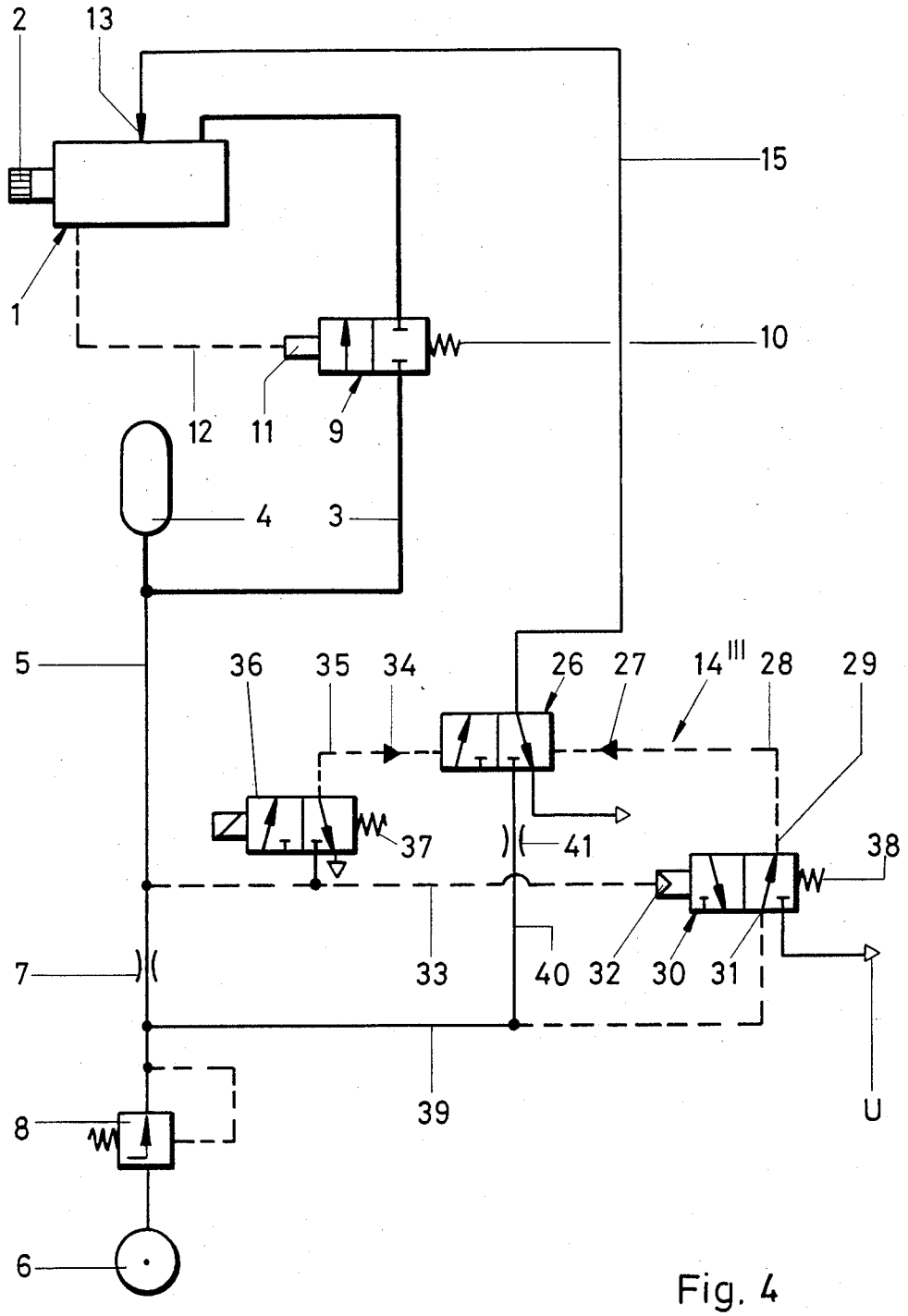

As illustrated, for example, in FIG. 4, a pressure reducing valve 8 of preferably small rated value may be provided between compressed air source 6 and the fluidic resistance means 7. Pressure reducing valve 8 is used, for example, when the pressure level of the compressed air source 6 does not coincide with the pressure level of the pressure reservoir 4.

A main valve 9 is provided in the supply line 3 between the filling line 5 and starter 1. Main valve 9 is held in the closed position by means of a compression spring 10. A switching connection of main valve 9 may be structurally integrated in the starter 1. This connection 11 is connected through a pneumatic control line 12 to the meshing unit of the starter 1.

Moreover, to the meshing unit of the starter 1 is assigned a signal input 13 for a pneumatic signal line 15 which leads to a control device 14, 14', 14'', 14''' which shall be explained in more detail below.

In the embodiment illustrated in FIG. 1, the signal line 15 is connected to a signal output 16 of control device 14. As further illustrated in FIG. 1, control device 14 includes a sensor input 17 for the pressure level in the pressure reservoir 4, a signal input 18 for introducing the starting signal and an input 19 for supplying the auxiliary energy required for signal formation. Preferably, the auxiliary energy is compressed air. However, the signal carriers may also be other forms of energy, for example, electrical, mechanical or hydraulic energy. This is true also for the signal transmission between the signal input 13 at the starter 1 and the control device 14 and between the meshing unit and the switching connection 11 of the main valve 9. When a starting signal is provided at the signal input 18 of control device 14, the auxiliary energy supplied through input 19 causes the meshing unit to be displaced through signal line 15 and signal input 13 at starter 1. When the meshing procedure is concluded, i.e., when the meshing pinion 2 has reached the desired position in the flywheel of the internal combustion engine, the main valve 9 is moved into the open position through control line 12, so that the starter motor is now actuated through supply line 3.

When the pressure drops in the pressure reservoir 4 toward the end of the starting procedure, sensor input 17 at the control device 14 indicates that the necessary work pressure is no longer available, so that the connection between the input 19 for supplying the auxiliary energy and the signal output 16 is interrupted and, thus, the signal input 13 at starter 1 becomes pressureless. Consequently, the force of spring 10 at main valve 9 overcomes the pneumatic force at switching connection 11 and displaces the main valve 9 back into the initial position shown in the drawings. Compressed air is now no longer supplied to the starter 1 and the starter motor.

Figure 2:
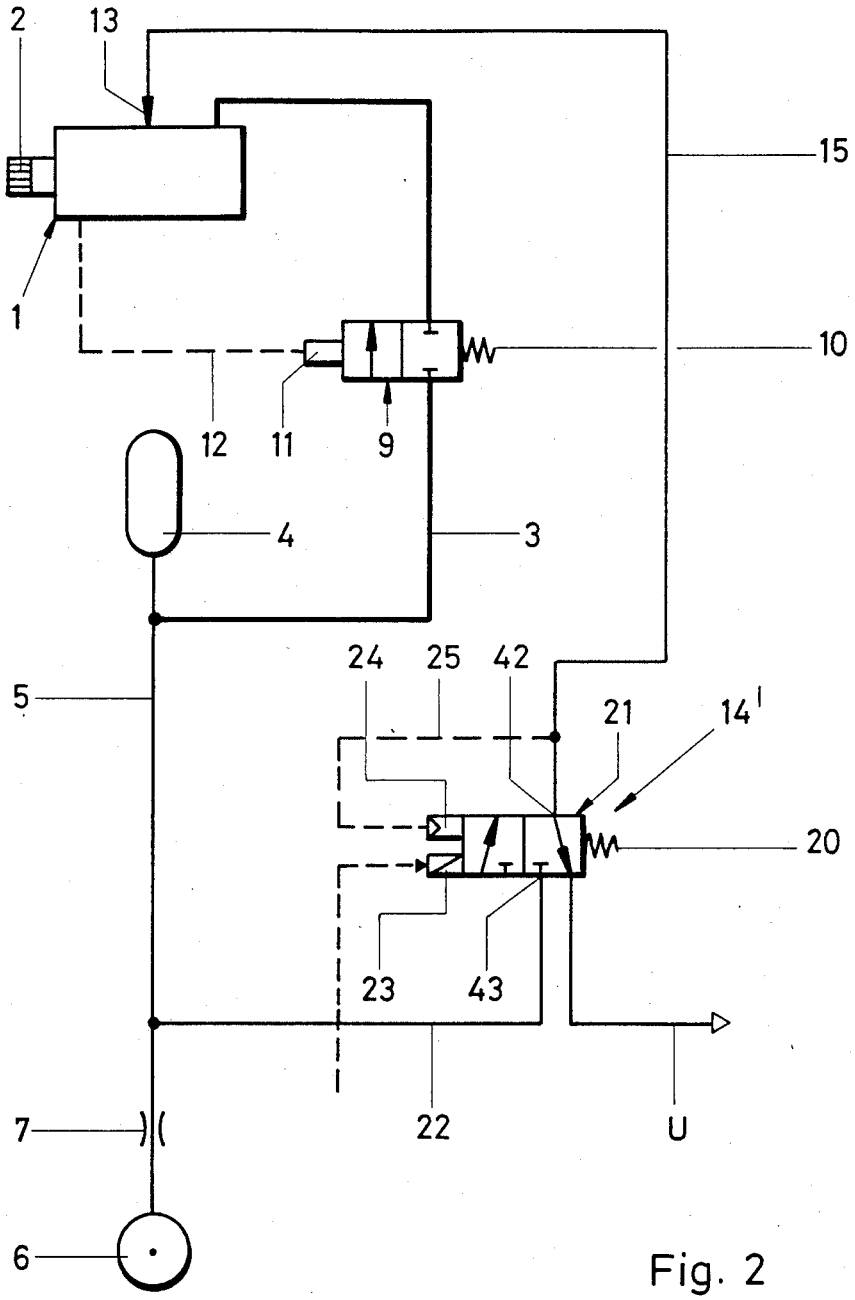

In the embodiment illustrated in FIG. 2, control device 14' includes a pneumatic control valve 21 which is switchable against the force of a compression spring 20. An input work connection 43 of control valve 21 is connected through a line 22 to the filling line 5 between the fluidic resistance means 7 and the pressure reservoir 4. As can also be seen in FIG. 2, the signal line 15 leading to the signal input 13 of starter 1 is connected to control valve 21 through an output work connection 42.

The signal connection 23 for introducing the starting signal is constructed as a connection which can be electrically actuated. The sensor input 24 for the indirect transmission of the pressure level in the pressure reservoir 4 is connected through a coupling line 25 to the signal line 15.

When the control valve 21 is displaced toward the right as seen in FIG. 2 by means of signal input 23 against the resetting force of compression spring 20, line 22 is connected to signal line 15 so that compressed air can be transmitted. As a result, a sufficiently high pressure also exists at sensor input 24 which pressure maintains control valve 21 in the reverse position against the force of resetting spring 20. Compressed air can now reach and displace the meshing unit. At the end of the meshing procedure, a pressure signal is applied to main valve 9 through control line 12. The main valve line is now reversed and the starter motor receives driving air from pressure reservoir 4. As a result of the pressure drop at the end of the starting procedure, the force of the resetting spring 20 of control valve 21 overcomes the pressure at the sensor input 24 and control valve 21 is returned into the initial position illustrated in the drawing in which the signal input 13 of the meshing unit is again connected to surrounding U, so that finally the main valve 9 is returned into the closed position under the influence of compression spring 10.

Figure 3:
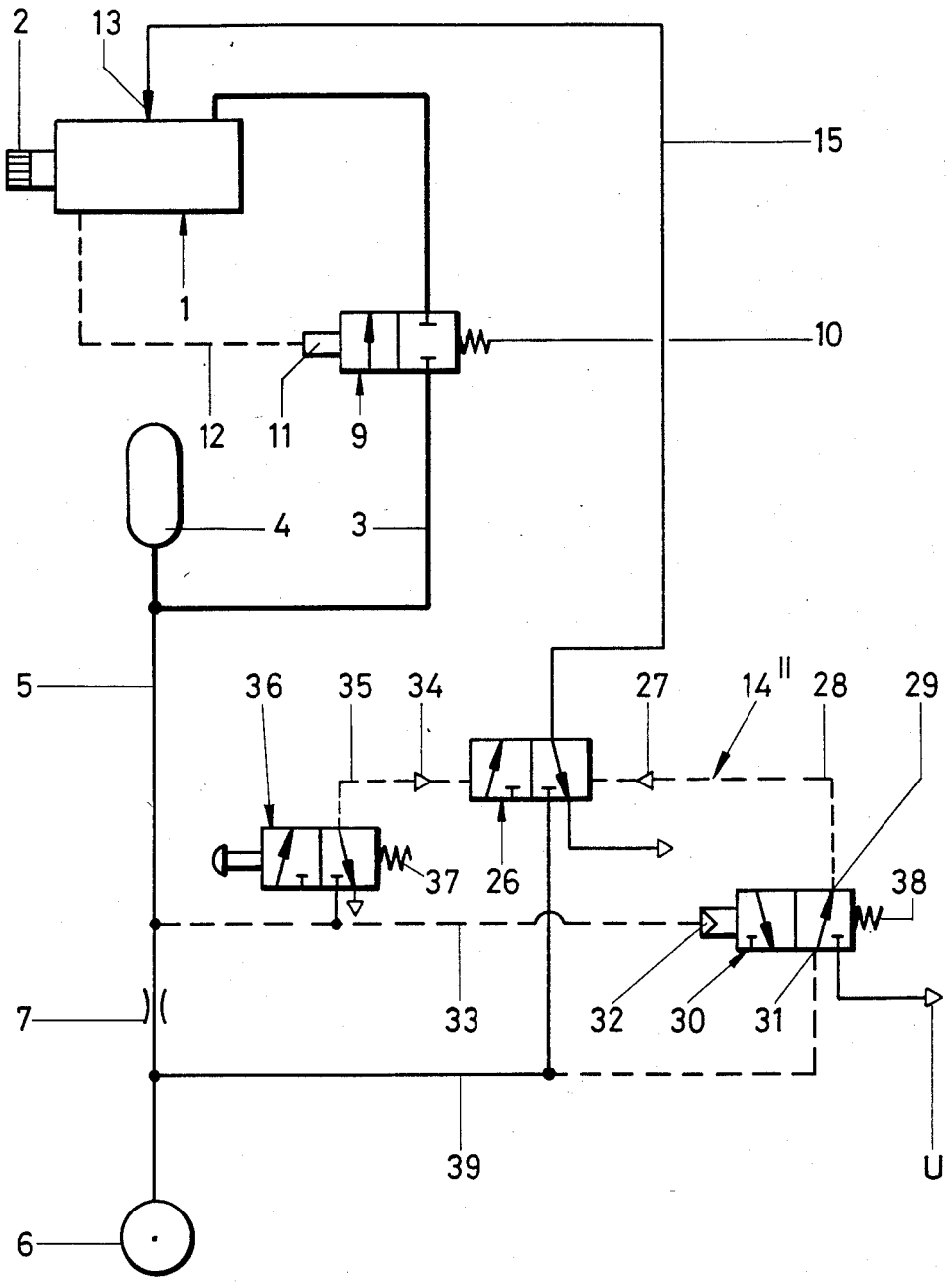

The embodiments of the invention illustrated in FIGS. 3 and 4 include control devices 14''' and 14''' in which the signal lines 15 are each conducted to the signal inputs at the starters 1 over a flip-flop valve 26 and are connected to the filling line 5 between the compressed air source 6 and the fluidic resistance means 7. A switching connection 27 of flip-flop valve 26 is in connection with output work connection 27 of the control valve 30 through a control line 28, while input work connection 31 of the control valve 30 is connected to filling line 5. The switching connection 32 of control valve 30 is in connection with filling line 5 through a control line 33 in the region between the fluidic resistance means 7 and the pressure reservoir 4.

The other switching connection 34 of flip-flop valve 26 is connected through a control line 35 to a starting valve 36 or 36' which, in turn, is connected to the above-mentioned control line 33.

In the initial position, a compression spring 37 maintains starting valve 36, 36' in a locked position in which no compressed air can reach the switching connection 34 of flip-flop valve 26. The compressed air existing in control line 33 and at switching connection 32 of control valve 30 maintains control valve 30 in a position against the resetting force of a compression spring 38 in which position the compressed air existing in line 39 cannot pass through control valve 30. Flip-flop valve 26 is in the closed position.

By a temporary shifting of the starting valve 36, 35', compressed air reaches the switching connection 34 of flip-flop valve 26 and displaces the latter into its right hand side position as shown in the drawing in which compressed air can now reach from line 39 through signal line 15 to the signal input 13 of the meshing unit. At the end of the meshing procedure, the displacement of main valve 19 is effected through control line 12, so that compressed air can now be conducted from pressure reservoir 4 to the starter motor through supply line 3.

The pressure drop at the end of the starting procedure enables the resetting force of compression spring 38 of control valve 30 to overcome the pressure existing at the switching connection 32 and, thus, ensures that control valve 30 is transferred into the position illustrated in the drawing in which pressure medium or compressed air is conducted to the switching connection 27 of the flip-flop valve 26 and returns the latter into the position illustrated in the drawing in which a further supply of compressed air to signal input 13 of the meshing unit is stopped. Thus, the resetting force of compression spring 10 of the main valve 9 overcomes the pneumatic pressure existing at switching connection 11 and returns main valve 9 into the closed position illustrated in the drawings. Any further supply of the compressed air to the starter motor is stopped.

When the starting device is a hysteresis device, an additional fluidic resistance means 41 is provided in line 40 between line 39 and flip-flop valve 26. This feature is illustrated in FIG. 4.

FIG. 4 further shows that instead of a manually actuated pushbutton-type valve, the starting valve 36 of FIG. 3 may also be an electrically controlled pulse-type valve 36'.

While the specific embodiments of the invention have been shown and described in detail to illustrate the application of the inventive principles, it will be understood that the invention may be embodied otherwise without departing from such principles.

We claim:

1. A compressed air starting device comprising a starter with a starter motor operated at least indirectly from a pneumatic pressure reservoir and a meshing unit controlled by a signal input, a main valve connected in the supply line between the pressure reservoir and the starter motor, a signal connection between the meshing unit and the main valve, a control device, the control device including a sensor input for the pressure level in the pressure reservoir, a signal output connected to the signal input of the starter, a control device signal input for introducing the starting signal, and an energy input for supplying the auxiliary energy required for generating signals.

2. The compressed air starting device according to claim 1, wherein the auxiliary energy is compressed air, and the signals at the starter signal input, the signals at the switching connection of the main valve and the signals at the sensor input of the control device are pneumatic pressure signals.

3. The compressed air starting device according to claims 1 or 2, comprising a pressure source permanently connected to the pressure reservoir, and a fluidic resistance means connected in a filling line provided between the pressure source and the pressure reservoir.

4. The compressed air starting device according to claim 3, wherein a pressure reducing valve is provided in the filling line between the pressure source and the pressure reservoir.

5. The compressed air starting device according to claim 3, wherein the control device comprises a first pneumatic control valve switchable against the force of a first resetting means, the control valve comprising an input work connection directly connected to the pressure reservoir, a signal connection for introducing the starting signal and an output work connection connected to the starter signal input, wherein the sensor input is coupled to a signal line between the output work connection and t.he starter signal input.

6. The compressed air starting device according to claim 3, wherein the control device comprises a second pneumatic control valve switchable against the force of a second resetting means, a switching connection and an input work connection of the control valve being connected to the filling line between the pressure source and the pressure reservoir, wherein an output work connection of the control valve is connected to a switching connection of a flip-flop valve provided in a signal line between the starter signal input and the filling line, another switching connection of the flip-flop valve being connected to a line which is connected to the pressure reservoir and is conducted through a starter valve.

7. The compressed air starting device according to claim 6, wherein a fluidic resistance means is connected in the line between the flip-flop valve and the filling line.

8. The compressed air starting device according to claim 1, wherein the capacity of the pressure reservoir is such that the compressed air contained therein is sufficient for carrying out a single starting procedure.

* * * * *